US007121187B2

(12) United States Patent
Holder

(10) Patent No.: US 7,121,187 B2
(45) Date of Patent: Oct. 17, 2006

(54) FLUID POWERED CONTROL SYSTEM WITH A LOAD PRESSURE FEEDBACK

(75) Inventor: Robert Edward Holder, Los Angeles, CA (US)

(73) Assignee: Eaton Corporation, Cleveland, OH (US)

( * ) Notice: Subject to any disclaimer, the term of this patent is extended or adjusted under 35 U.S.C. 154(b) by 39 days.

(21) Appl. No.: 11/034,417

(22) Filed: Jan. 12, 2005

(65) Prior Publication Data

US 2006/0150623 A1 Jul. 13, 2006

(51) Int. Cl.
*F15B 11/10* (2006.01)

(52) U.S. Cl. ..... 91/433; 60/493

(58) Field of Classification Search ..... 91/433; 60/493; 137/625.64, 625.66
See application file for complete search history.

(56) References Cited

U.S. PATENT DOCUMENTS 3,799,200 A * 3/1974 Tipton ..... 91/433
3,872,671 A * 3/1975 Verlinde ..... 60/493
4,320,782 A * 3/1982 Pauliukonis ..... 137/625.65
4,643,225 A * 2/1987 Imhof ..... 137/625.64
5,251,671 A * 10/1993 Hiroki ..... 91/433
5,284,220 A * 2/1994 Shimizu et al. ..... 137/625.65
5,497,692 A * 3/1996 Marcott ..... 91/459
5,992,294 A * 11/1999 Seddon ..... 91/433

* cited by examiner

*Primary Examiner*—Edward K. Look
*Assistant Examiner*—Michael Leslie
(74) *Attorney, Agent, or Firm*—Marvin L. Union

(57) ABSTRACT

An apparatus controls fluid flow to an actuator. A feedback mechanism responds to a pressure differential that occurs across the actuator by altering the fluid flow. That pressure differential indicates acceleration of the actuator that can occur when the load acting thereon varies. Thus as the actuator accelerates, the apparatus reduces the flow of fluid which counteracts the acceleration and maintains the actuator speed relatively constant. A unique directional control valve incorporates the feedback mechanism that functions regardless of the direction in which the actuator moves.

15 Claims, 2 Drawing Sheets

FLUID POWERED CONTROL SYSTEM WITH A LOAD PRESSURE FEEDBACK

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the control of hydraulic actuators, and more particularly to controlling the speed of a hydraulic motor under varying load conditions.

2. Description of the Related Art

Some hydraulic motors have inherently low damping which makes accurate speed control difficult under varying load conditions. As a result, the device being moved by the motor may overshoot or undershoot a desired position or operate at too great a velocity if velocity is the controlled attribute.

For example, hydraulic motors are used to open and close the weapons bay doors on military aircraft. If the door does not open fully because of an unexpectedly large load acting of the motor, such as a high speed wind, the weapons may not fully deploy. Conversely if the load is unexpectedly small and the motor operates longer than necessary, the door will be forced against a mechanical stop which can damage the door or the motor. In addition to changing load conditions, other factors, such as variation of hydraulic fluid flow to the motor, also affect the speed of the motor. Thus, if the motor is operated based on an assumed speed and the actual speed is different, the member being moved may not be properly positioned.

Therefore, it is desirable to provide a mechanism to determine when various factors cause variation in motor speed and compensate for that variation.

SUMMARY OF THE INVENTION

An apparatus is provided to control a fluid powered actuator that has a first port and a second port. A directional control valve includes a sleeve with a longitudinal bore into which an inlet and a first workport open. A valve spool is slidably received within the bore and has one position in which the inlet is in fluid communication with the first workport, and another position in which communication between the inlet and the first workport is blocked. A feedback mechanism that applies pressure from the first and second port of the fluid power actuator to the valve spool, wherein when pressure in the first port exceeds pressure in the second port a force is produced which tends to move the valve spool from the first position to the second position.

A significant pressure differential occurs between the first and second ports as the fluid power actuator accelerates, which happens as the load acting on that actuator varies. The feedback mechanism responds to that pressure differential by causing the directional control valve to reduce the flow of fluid to the fluid power actuator, thereby counteracting the acceleration and maintaining the actuator speed relatively constant.

In a preferred embodiment of the present apparatus, the directional control valve has first and second workports to which the ports of the fluid power actuator connect. The valve spool has a first annular groove and a second annular groove. In a first position of the valve spool, the first annular groove connects the first workport to the inlet and the second annular groove provides connection between the second workport and the outlet. In a second position, the first annular groove couples the first workport to the outlet and the second annular groove connects the second workport to the inlet. The valve spool has a third position in which the inlet and the outlet are isolated from both the first and second workports.

The load pressure feedback mechanism of that preferred embodiment comprises a first feedback piston slideably received in a first aperture at one end of the valve spool and forming a first spool cavity there between. A second feedback piston is slideably received in a second aperture at an opposite end of the valve spool, thereby creating a second spool cavity there between. A first passage is provided in the valve spool to convey pressure in the first annular groove to the first spool cavity, and a second passage conveys pressure in the second annular groove to the second spool cavity.

The directional control valve preferably is pilot operated and has a first chamber in the bore at one end of the valve spool and a second chamber in the bore at an opposite end of the valve spool. In this case, the apparatus further may comprise a variable orifice coupling a supply line to the inlet of the directional control valve and a pilot valve which alternately couples a node to the supply line or a return line in response to a pressure differential across the variable orifice. A valve assembly couples the node to either the first chamber and to the second chamber to move the valve spool into the first or second position, respectively.

DETAILED DESCRIPTION OF THE INVENTION

Figure 1:
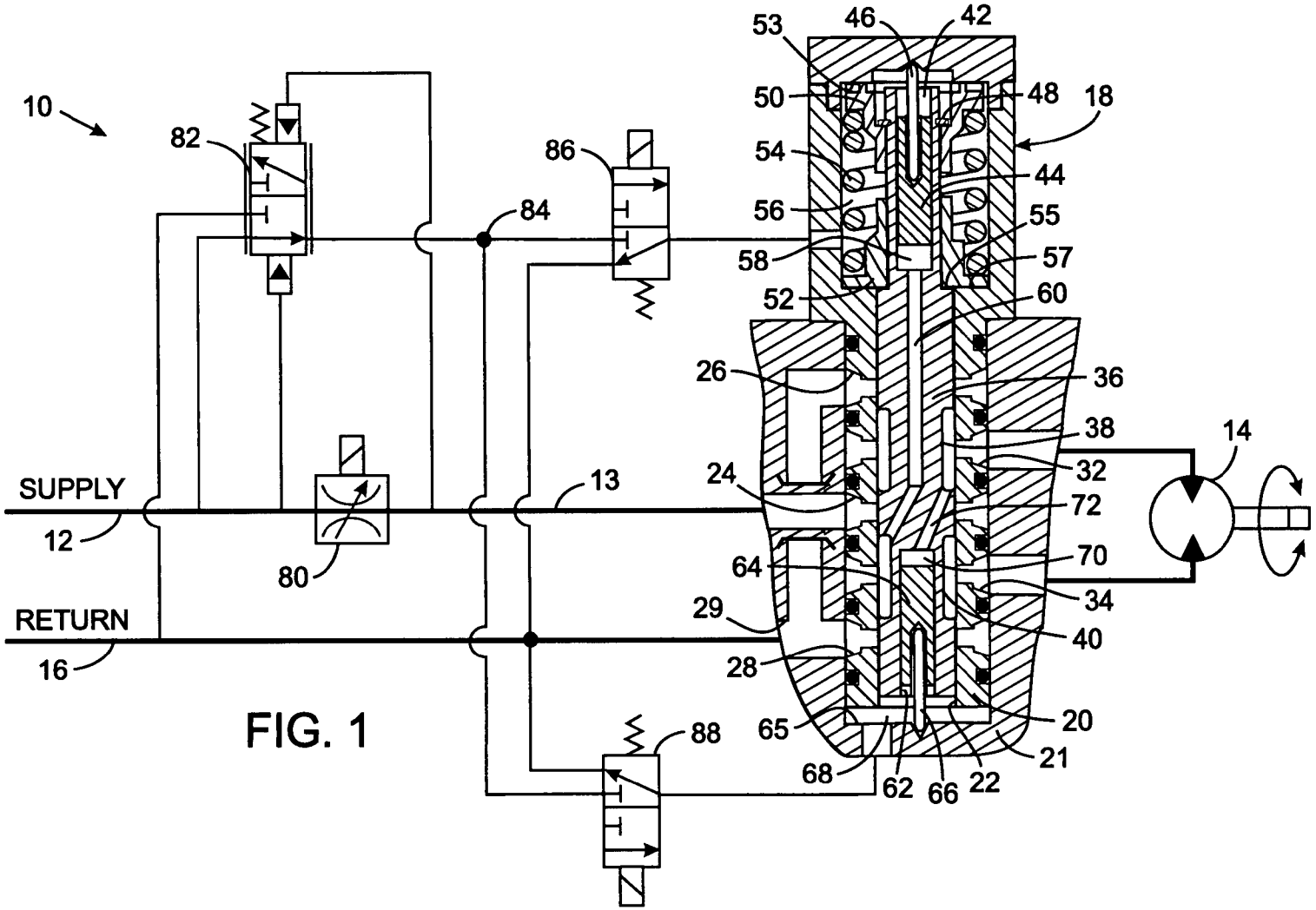
FIG. 1 is a schematic diagram of a hydraulic motor control circuit that includes a load pressure feedback mechanism.

With initial reference to FIG. 1, a hydraulic circuit 10 controls the flow of pressurized fluid from a supply line 12 to a fixed displacement hydraulic motor 14. The fluid exiting the hydraulic motor 14 is directed into a return line 16 that leads to a reservoir (not shown). Although the inventive concepts are being described in the context of controlling a fixed displacement hydraulic motor, they can be utilized with a variable displacement motor.

The hydraulic motor 14 can be driven in either of two directions depending upon the position of a pilot-operated, directional control valve 18. The directional control valve 18 has a sleeve 20 that rests within an aperture in a body 21 which combined form a valve housing. The sleeve has a longitudinal bore 22 and a transverse inlet port 24 to receive pressurized fluid from the supply line 12 and convey that fluid into the bore. First and second outlet ports 26 and 28 provide passages on opposite sides of the inlet port for fluid to flow from the bore 22 through an common outlet port 29 into the return line 16. A first workport 32 extends from the longitudinal bore 22 transversely through the valve sleeve 20 at a position between the inlet port 24 and the first outlet port 26. A second workport 34 provides another opening from the longitudinal bore 22 at a position between the inlet port 24 and the second outlet port 28. The hydraulic motor 14 is connected to the two workports 32 and 34.

A valve spool 36 is slidably received within the longitudinal bore 22 of the sleeve 20. The valve spool 36 has first and second annular grooves 38 and 40 around the exterior that provide paths between the various ports in different positions of the valve spool, as will be described. A first feedback piston 44 is slidably positioned within an aperture 42 at one end of the valve spool 36 that is within a spring chamber 56 of the longitudinal bore 22. A first spool cavity 58 is formed within the spool aperture 42 adjacent the interior end of the first feedback piston 44 and is connected by a first passage 60 to the second annular groove 40. A first pintle 46 is received within a hole in the first feedback piston 44 and has an exposed end that engages a wall 53 of the spring chamber 56. A ring clip 48 is secured within an exterior annular notch near this end of the valve spool 36 and engages a first spring retainer 50 through which the valve sleeve extends. A second spring retainer 52 abuts a shoulder 55 on the spool 36 farther away from that one end. A compression spring 54 is located between the two spring retainers 50 and 52. When pilot pressure is not being applied to the directional control valve 18, the compression spring 54 forces the spring retainers 50 and 52 against opposing walls 53 and 57 of the spring chamber 56, which centers the valve spool 36 within the longitudinal bore 22. In that centered position, the annular spool grooves 38 and 40 do not provide paths between the ports 24, 26, 28, 32 and 34 and the directional control valve 18 is in a closed state.

A second aperture 62 is formed at the opposite end of the valve spool 36 from the first aperture 42. A second feedback piston 64 is slidably received within this second aperture 62 and abuts a second pintle 66 that engages a wall 65 of the body 21 which forms another end of the longitudinal bore 22. A nose chamber 68 is located between the body 21 and the end of the sleeve 20 adjacent the second feedback piston 64. A second spool cavity 70 is created between the second feedback piston 64 and the bottom of the second spool aperture 62. A second passage 72 couples the second spool cavity 70 to the first annular groove 38 around the spool 36.

With continuing reference to FIG. 1, the return line 16 connects directly to the first and second outlet ports 26 and 28. The supply line 12 is coupled by a variable orifice 80 to a secondary supply line 13 that leads to the inlet port 24. The variable orifice 80 controls the motor speed and can be dynamically varied by an electrical actuator, such as a solenoid. The directional control valve 18 is a pilot operated device in which the spool 36 moves within the longitudinal bore 22 in response to the application of pressure to the spring chamber 56 or the nose chamber 68. Application of that pressure is controlled by a three-way, proportional pilot valve 82 and two solenoid valves 86 and 88. The pilot valve 82 selectively couples a node 84 to either the supply line 12 or the return line 16 in response to a pressure differential across the variable orifice 80. The force of a spring in the pilot valve 82 defines the differential pressure setting at which that valve opens. A first solenoid valve 86 selectively couples the spring chamber 56 of the directional control valve 18 to either the node 84 or the return line 16. A second solenoid valve 88 selectively couples the nose chamber 68 to either the node 84 or the return line 16. Which one of the first and second solenoid valves 86 and 88 connects the node to the directional control valve 18 determined the rotational direction on the directional control valve 18 motor 14.

The speed at which the hydraulic motor 14 rotates is proportional to the flow from the supply line 12 which is controlled by the variable orifice 80. The differential pressure across the variable orifice 80 corresponds to the supply line flow and is sensed by the three-way pilot valve 82 which is driven into a position that is proportional to the magnitude of that pressure. The pilot valve position produces a control pressure at node 84 that corresponds to the flow from the supply line into the directional control valve 18. That control pressure is applied by one of the two solenoid valves 86 or 88 to either the spring chamber 56 or the nose chamber 68 to select the direction of the hydraulic motor 14. The magnitude of the control pressure at node 84 determines the amount that the directional control valve 18 opens and thus the speed of the motor 14.

Assume a fixed pressure setting of the pilot valve 82. The sensed differential pressure across the variable orifice 80 will be less than that pressure setting under relatively low flow conditions. In that case, the pilot valve 82 conveys the supply line pressure to node 84 and that pressure travels through the active solenoid valve 86 or 88 to increase the opening of the directional control valve 18. Opening the directional control valve 18 farther drives the motor 14 to a higher speed until the sensed pressure across the variable orifice 80 matches the pressure setting of the pilot valve 82. At that time, the pilot valve 82 assumes a position the maintains that motor speed.

Similarly during a relatively high flow condition, the sensed differential pressure exceeding the pressure setting causes the pilot valve 82 to close off node 84 from the supply line 12 and couple that node to the return line 16. In this state, both the spring chamber 56 and the nose chamber 84 of the directional control valve 18 are connected to the return line 16, either by a deactivated solenoid valve 86 or 88 or through the activated solenoid valve and the pilot valve 82. With both of these directional control valve chambers 56 and 68 at the return line pressure, the spring 54 forces the valve spool 36 toward the center, or closed, position to slow the hydraulic motor 14. Slowing of the hydraulic motor 14 eventually results in a low flow condition occurring through the variable orifice 80. At that time, a differential pressure is produced which again causes the pilot valve 82 to open a path between the supply line 12 and the node 84 to increase the flow of pressurized fluid to the motor 14.

A key feature of the hydraulic circuit 10 is a motor acceleration feedback mechanism provided by the two feedback pistons 44 and 64 incorporated in the directional control valve 18. The two feedback pistons 44 and 64 bear against the valve housing through two pintles 46 and 66. The pintles apply an axial load with a minimal lateral load that would adversely affect valve performance. The pressures at the two workports 32 and 34, conveyed by the respective spool passages 60 and 72 to the first and second spool cavities 58 and 70, act on the interior ends of the two feedback pistons 44 and 64. Because the motor torque is proportional to the differential workport pressure, that pressure differential provides a reasonable approximation of motor acceleration, which is the first derivative of motor speed. Feedback of the differential workport pressure (i.e. motor acceleration) is employed as a dampening coefficient in a servo-loop created in the directional control valve 18.

As noted previously, the size of the variable orifice 80 controls the motor speed and can be dynamically varied by an electrical actuator. The feedback mechanism provided by the feedback pistons 44 and 64 control the acceleration of the hydraulic motor 14 to maintain a relative constant speed under varying load conditions.

Figure 2:
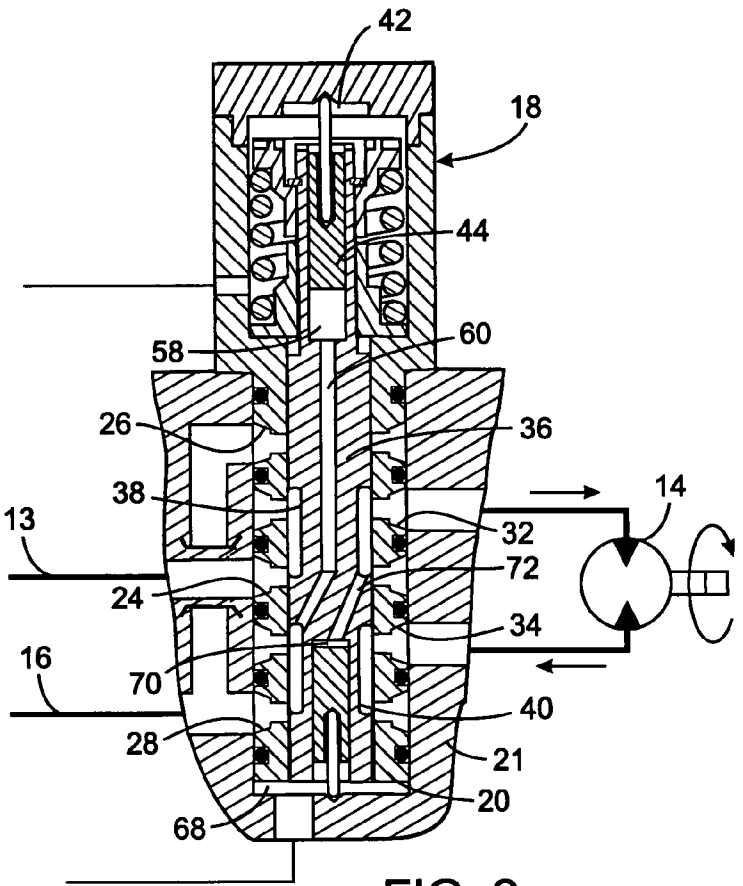
FIG. 2 illustrates a state of the directional control valve in FIG. 1 for operating the motor in one direction.

FIG. 2 illustrates the state of the directional control valve 18 that results from applying pressure from node 84 to the spring chamber 56 by activating the first solenoid valve 86 in FIG. 1. That action drives the valve spool 36 downward in the orientation of the valve in the drawings, so that the first annular groove 38 is positioned to create a path between the inlet port 24 and the first workport 32. This applies fluid from the supply lines 12 and 13 to the motor 14. After passing through the motor, the fluid reenters the directional control valve 18 via the second workport 34 from which it flows through a path provided by the second annular groove 40 to the second outlet port 28 and into the return line 16.

In this state, the first passage 60 through the spool 36 applies the fluid pressure returning from the motor at the second workport 34 to the first spool cavity 58 at the inner end of the first feedback piston 44. The second spool passage 72 conveys the motor driving pressure in the first workport 32 to the second spool cavity 70 at the inner end of the second feedback piston 64. An increase in the pressure differential across the motor causes a correspondingly acceleration of the motor and is denoted by a greater pressure in the second spool cavity 70 than occurs in the first cavity 58. That pressure differential between the spool cavities 58 and 70 creates a net force which moves the spool 36 upward in FIG. 2, reducing and maybe even closing communication between the supply input port 24 and the first workport 32. The change in the directional control valve 18 reduces the flow of fluid to the motor 14, whereby dampening the acceleration.

As the pressure differential across the motor deceases so does the motor acceleration which is denoted by a reduction in the difference in pressure between the first and second spool cavities 58 and 70. This pressure reduction causes the spool 36 to return to the position illustrated in FIG. 2 at which the first annular groove 38 again provides a larger path between the inlet port 24 and the first workport 32.

Figure 3:
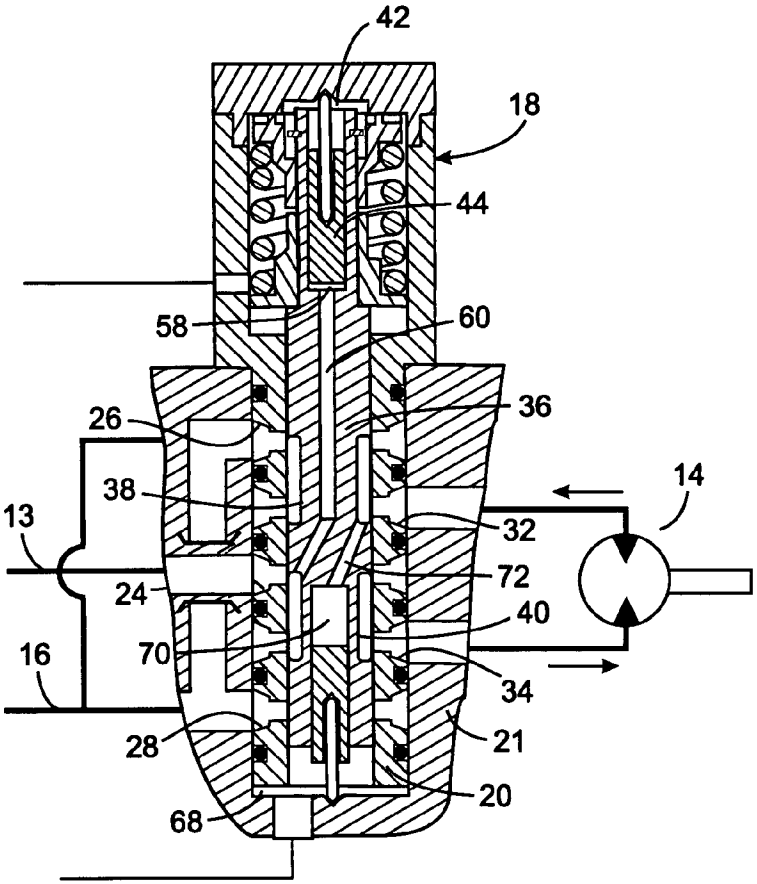
FIG. 3 illustrates the state of the directional control valve for operating the motor in the opposite direction.

FIG. 3 illustrates the directional control valve 18 in a position which operates the motor 14 in the opposite direction from that illustrated in FIG. 2. Here, the spool 36 is positioned so that the second annular groove 40 provides a path between the inlet port 24 and the second workport 34. The fluid exhausting from the motor 14 enters the first workport 32 and then flows via the first annular groove 38 to the first outlet port 26. In this state, the pressure of the fluid fed to the motor 14 via the second workport is communicated through the first spool passage 60 to the first spool cavity 58 at the inner end of the first feedback piston 44. The pressure of the fluid leaving the motor 14, which flows through the first annular groove 38, is applied via the second spool passage 72 to the second spool cavity 70 adjacent the second feedback piston 64.

As the motor 14 accelerates, the resultant pressure differential is reflected in the first and second spool cavities 58 and 70 with the pressure in the first spool cavity 58 being greater. This creates a force that tends to move the spool 36 downward in FIG. 3, closing off communication between the inlet port 24 and the second workport 34, thereby reducing the motor acceleration. As the acceleration decreases, the pressure differential across the motor similarly decreases which results in the pressures in the first and second spool cavities 58 and 70 tending to equalize. As that occurs, the spool 36 moves to enlarge the path between the inlet port 24 and the second workport 34. In this manner, the operation of the feedback piston limits the acceleration of the hydraulic motor 14.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. An apparatus for controlling a fluid power actuator that has a first port and a second port, said apparatus comprising a directional control valve having a sleeve with a longitudinal bore into which an inlet and a first workport open, the directional control valve including a valve spool slidably received within the bore and having a first position in which the inlet is in fluid communication with the first workport, and a second position in which communication between the inlet and the first workport is blocked; and a feedback mechanism comprising a first feedback piston slideably received in a first aperture at one end of the valve spool and forming a first spool cavity there between into which the pressure in the first port is applied, a first pintle engaging the first feedback piston and a first wall adjacent the one end of the bore, a second feedback piston slideably received in a second aperture at an opposite end of the valve spool and forming a second spool cavity there between into which the pressure in the second port is applied, a second pintle engaging the second feedback piston and a second wall adjacent the opposite end of the bore, wherein when pressure in the first port exceeds pressure in the second port a force is produced which tends to move the valve spool from the first position to the second position.

2. The apparatus as recited in claim 1 wherein the valve spool further comprises a first passage that conveys the pressure in the first port to the first spool cavity; and a second passage that conveys the pressure in the second port to the second spool cavity.

3. An apparatus for controlling a fluid power actuator comprising:

a directional control valve having a sleeve with a longitudinal bore into which an inlet, an outlet, a first workport and a second workport open, the directional control valve including a valve spool slidably received within the bore and having a first position in which the inlet is in fluid communication with the first workport and the outlet is in fluid communication with the second workport, a second position in which the outlet is in fluid communication with the first workport and the inlet is in fluid communication with the second workport, and a third position in which the inlet and the outlet are isolated from both the first and second workports;

a feedback mechanism that applies pressure from the first and second workports to the valve spool wherein when pressure in the first workport exceeds pressure in the second workport a force is produced which tends to move the valve spool from the first position to the third position, and when pressure in the first workport exceeds pressure in the second workport a force is produced which tends to move the valve spool from the first position to the third position;

a first chamber in the bore at one end of the valve spool;

a second chamber in the bore at an opposite end of the valve spool;

an orifice coupling a supply line to the inlet of the directional control valve;

a pilot valve which couples a node alternately to the supply line or a return line in response to a pressure differential across the orifice; and a valve assembly to selectively couple the node to the first chamber and to the second chamber.

4. The apparatus as recited in claim 3 wherein feedback mechanism comprises:

a first feedback piston slideably received in a first aperture at the one end of the valve spool and forming a first spool cavity there between into which the pressure in the first port is applied; and a second feedback piston slideably received in a second aperture at the opposite end of the valve spool and forming a second spool cavity there between into which the pressure in the second port is applied.

5. The apparatus as recited in claim 4 further comprising a first pintle engaging the first feedback piston and a first wall adjacent the one end of the bore; and a second pintle engaging the second feedback piston and a second wall adjacent the opposite end of the bore.

6. The apparatus as recited in claim 4 wherein the valve spool has a first annular groove that selectively provides a path between the first workport and the inlet in the first position and between the first workport and the outlet in the second position; and a second annular groove that selectively provides a path between the second workport and the outlet in the first position and between the second workport and the inlet in the second position.

7. The apparatus as recited in claim 6 wherein the valve spool further comprises a first passage that conveys the pressure in the first annular groove to the first spool cavity; and a second passage that conveys the pressure in the second annular groove to the second spool cavity.

8. The apparatus as recited in claim 3 wherein the valve assembly comprises:

a first electrically operated valve that alternately couples the first chamber to the node and to the return line; and a second electrically operated valve that alternately couples the second chamber to the node and to the return line.

9. The apparatus as recited in claim 3 wherein in the orifice is variable in size.

10. The apparatus as recited in claim 3 further comprising a spring assembly with a single spring that applies force that tends to move the valve spool from both the first and second positions into the third position.

11. An apparatus for controlling a fluid power actuator comprising a directional control valve having a sleeve with a longitudinal bore into which an inlet, an outlet, a first workport and a second workport open, the directional control valve including a valve spool slidably received within the bore and including a first annular groove and a second annular groove in the valve spool, wherein the valve spool has a first position in which the first annular groove connects the first workport to the inlet and the second annular groove connects the second workport to the outlet, a second position in which the first annular groove connects the first workport to the outlet and the second annular groove connects the second workport to the inlet, and a third position in which the inlet and the outlet are isolated from both the first and second workports;

a spring assembly with a single spring that applies force that tends to move the valve spool from both the first and second positions into the third position; and a feedback mechanism that comprises a first feedback piston slideably received in a first aperture at one end of the valve spool and forming a first spool cavity there between, a second feedback piston slideably received in a second aperture at an opposite end of the valve spool and forming a second spool cavity there between, a first passage that conveys pressure in the first annular groove to the first spool cavity, and a second passage that conveys pressure in the second annular groove to the second spool cavity.

12. The apparatus as recited in claim 11 further comprising a first pintle engaging the first feedback piston and a first wall adjacent the one end of the bore; and a second pintle engaging the second feedback piston and a second wall adjacent the opposite end of the bore.

13. The apparatus as recited in claim 11 wherein the directional control valve is pilot operated and comprises a first chamber in the bore at one end of the valve spool and a second chamber in the bore at an opposite end of the valve spool.

14. The apparatus as recited in claim 13 further comprising:

a variable orifice coupling a supply line to the inlet of the directional control valve;

a pilot valve which alternately couples a node to the supply line or a return line in response to a pressure differential across the variable orifice;

a valve assembly to selectively couple the node to the first chamber and to the second chamber.

15. The apparatus as recited in claim 14 wherein the valve assembly comprises:

a first electrically operated valve that alternately couples the first chamber to the node and to the return line; and a second electrically operated valve that alternately couples the second chamber to the node and to the return line.

* * * * *